United States Patent [19]

Beyl

[11] 4,077,653

[45] Mar. 7, 1978

[54] HEEL HOLD-DOWN PLATE OR PIVOT MEMBER OF SAFETY SKI BINDING

[76] Inventor: Jean Joseph Alfred Beyl, Boulevard Victor Hugo, 58000 Nevers, France

[21] Appl. No.: 633,935

[22] Filed: Nov. 20, 1975

[30] Foreign Application Priority Data

Nov. 29, 1974 France ..... 74 39308

[51] Int. Cl.[2] ..... A63C 9/08

[52] U.S. Cl. ..... 280/620; 280/618

[58] Field of Search ..... 280/620, 618, 627, 636, 280/611, 634, 613

[56] References Cited

U.S. PATENT DOCUMENTS

| | | | |
|---|---|---|---|
| 3,172,678 | 3/1965 | Beyl | 280/620 |
| 3,210,090 | 10/1965 | Keeling et al. | 280/620 |
| 3,357,713 | 12/1967 | See, Jr. | 280/620 |
| 3,866,928 | 2/1975 | Gertsch et al. | 280/618 |

*Primary Examiner*—Joseph F. Peters, Jr.

*Assistant Examiner*—Milton L. Smith

*Attorney, Agent, or Firm*—Bierman & Bierman

[57] ABSTRACT

A pivoting support adapted to be secured to a ski for receiving the heel member of a ski boot safety ski binding arrangement, which comprises in combination a pivot means adapted to be adjustably secured to the ski; plate means adapted to receive the heel portion of the ski boot and rotatably mounted to said pivot means, and an aperture formed in said plate means and having said pivot means disposed therein. The contours of said aperture and said pivot means are respectively shaped to permit certain movements of said plate means in the longitudinal direction of the ski. The guiding surfaces formed on said pivot means are adapted to guide said plate in the longitudinal direction while holding said plate against movement in the transverse direction by interposition of resilient means between said pivot means and said plate.

8 Claims, 8 Drawing Figures

HEEL HOLD-DOWN PLATE OR PIVOT MEMBER OF SAFETY SKI BINDING

BACKGROUND OF THE INVENTION

1. Field of the Invention

The present invention relates to safety ski bindings in general and more specifically to an improved releasable and rotatable plate, turntable or pivot member associated with the heel hold-down device of the binding, wherein the plate or pivot member is rotatably mounted with the assistance of a mounting member rigid with the ski.

2. Description of the Prior Art

Among the hitherto known types of safety ski bindings there is a group of bindings comprising the so-called releasable plate, platform or turntable bindings and the so-called releasable pivot bindings. Regarding the turntable bindings, reference is made herein to those wherein the plate or turntable is disposed around a pivot member rigid with the ski and adapted to pivot in a plane parallel to the top surface of the ski. The purpose of these two types of bindings is to position the virtual fulcrum of the binding, during the release of the ski boot as a consequence of torsional stress, as close as possible to the axis of the skier's tibia and thus provide constant lever arms. Now, during actual skiing practice and notably when negotiating bumps, the ski is bent varying amounts and therefore either the ski boot sole or the plate is compressed undesirably between the safety members of the binding unless safety members are provided so that they can yield resiliently in the longitudinal direction of the ski.

To avoid this detrimental compression, a known solution consisted of providing an elongated hole through the plate surrounding or enclosing the pivot means rigid with the ski so that the plate could move in the longitudinal direction thereof. The plate then is resiliently urged and returned to its normal position at the end of the ski's bending movement by the safety means incorporated into the binding.

In the case of pivot bindings, it has already been proposed to prevent this undesired compression of the ski boot between the safety members when clearing bumps, by allowing the heel hold-down device to move against the resilient force of the safety mechanism towards the rear end of the ski and to be restored to its normal position by the safety mechanism.

Now these two prior art solutions are objectionable in that during normal ski bending movements that occur when skiing, the turntable or the heel hold-down device accomplishes a longitudinal movement which prestresses the mechanism controlling the release of the safety members, whereby either the release forces are increased or the release takes place untimely. These two effects are highly detrimental from the dual point of view of safety and skiing technique. In addition, they increase the risk of injury.

SUMMARY OF THE INVENTION

It is the essential object of the present invention to provide a turntable or pivot-type heel hold-down safety ski binding in which a turntable or pivot means of the type broadly set forth hereinabove is of reduced dimensions and capable of completely separating the longitudinal movements of the turntable or pivoting heel hold-down device of a ski binding from the resilient pivotal return movement thereof, and thus avoid the abovementioned inconveniences. A further object is to provide an improved arrangement of the turntable or pivot means so that the purely transverse stresses generated during skiing are absorbed directly by the mounting member rigid with the ski.

With this end in view, the present invention, in a device of the type broadly set forth in the foregoing, provides a specific arrangement of the pivoting member or heel hold-down device on the mounting member, with the interposition of a spring means, so that said turntable or heel hold-down device can move in the longitudinal direction of the ski and the turntable or the mounting member can be safely held against movement at right angles to the ski axis.

In a preferred and advantageous form of embodiment of the present invention, the pivoting member comprises an aperture enclosing within its inner circumferential surface the mounting member. The latter has guide faces on which the circumferential surface of said aperture is guided in the longitudinal direction of the ski. The mounting member comprises on at least one side, a resilient means engaging said circumferential surface of the aperture in the longitudinal direction of the ski.

According to a typical form of embodiment of this invention, said resilient means advantageously consist of a curved spring blade engaging with its free arms the circumferential surface of the aperture.

In a modified form of embodiment of this invention, the pivoting member comprises a circular aperture enclosing the mounting member in the circumferential surface of said aperture, and at least one portion of this circumferential surface consists of a segment or insert guided within the pivoting turntable or member in the longitudinal direction of the ski while bearing against said turntable or member through the medium of one or a plurality of springs.

Further features and advantages of the present invention will become apparent from the following detailed description and the attached drawings which are a part of the specification and in which:

DETAILED DESCRIPTION OF THE PREFERRED EMBODIMENTS

Figure 1:
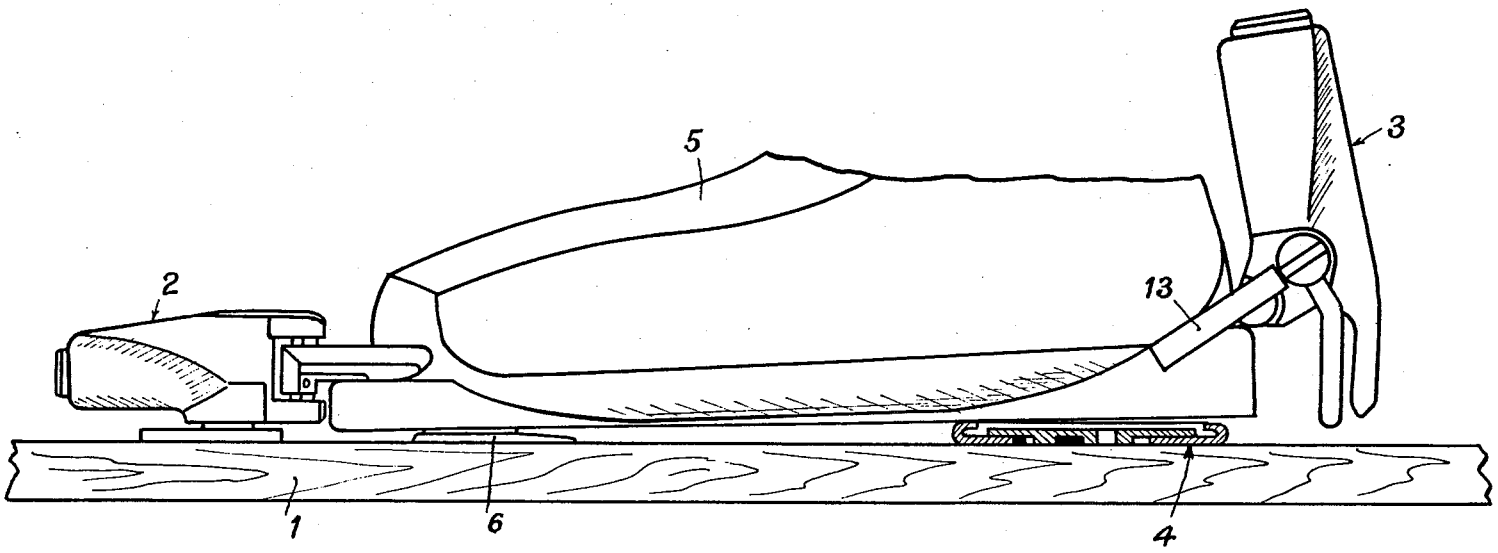
FIG. 1 is a diagrammatical side-elevational view of a safety ski binding of the heel hold-down turntable type comprising a turntable and pivot means according to this invention.

In the pivot-member type safety ski binding illustrated in FIG. 1, which incorporates a device according to this invention, a toe end safety binding 2 and a heel hold-down safety binding 3 are mounted on a ski in a manner known per se. The heel hold-down device 3 is mounted in fact on a pivot member 4 in such a way that a ski boot 5 inserted between the toe end safety binding 2 and the heel hold-down safety binding 3 bears on said pivot member 4 and preferably also on a slide member 6. Skiing on relatively deep concavities in the snow surface causes a pronounced bending of the ski and a shortening of the distance between the toe end device 2 and the heel hold-down device 3. Thus, due to the inherent stiffness of the ski boot, a relatively strong pressure may be exerted by the sole against the toe-end binding 2 so as to increase the forces tending to retain the boot in position. To avoid this undesirable result, the pivot member 4 is provided and it comprises, according to this invention, a device permitting a certain longitudinal controlled movement of the pivot member supporting the heel hold-down device 3 in relation to the ski 1.

Figure 2:
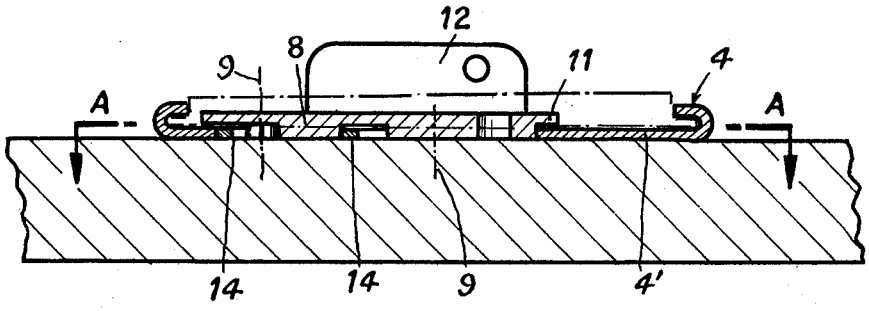
FIG. 2 is a longitudinal section showing a device according to this invention in the case of a pivot member as shown in FIG. 1, the section being taken along the plane B—B of FIG. 3.
Figure 3:
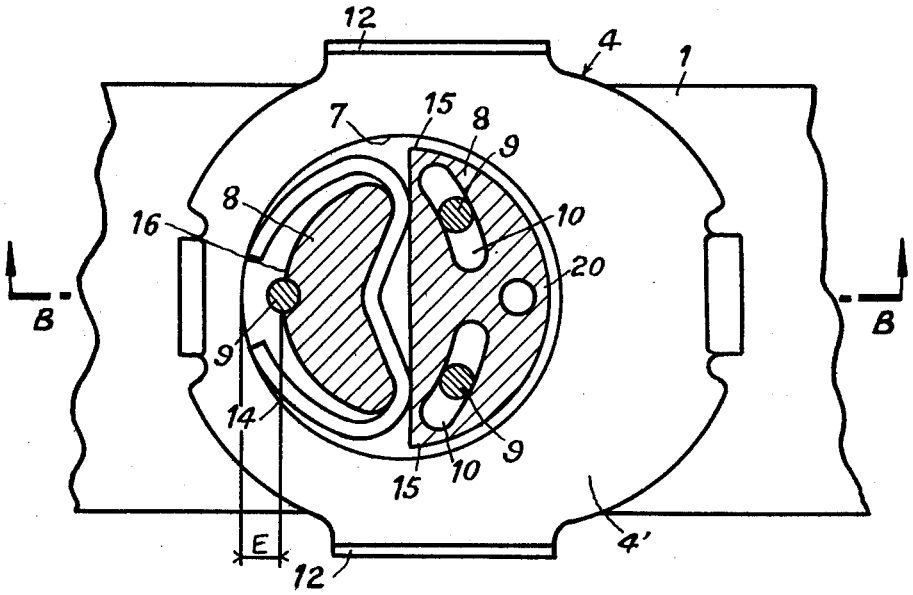
FIG. 3 illustrates a device according to this invention, shown in section taken along the plane A—A of FIG. 2.
Figure 4:
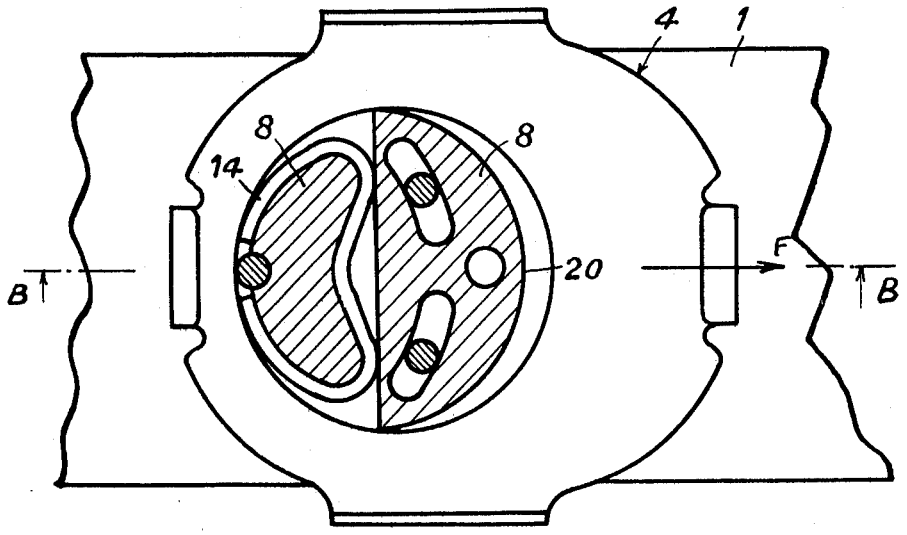
FIG. 4 is another view of the device shown in FIG. 3 but with the pivoting member shown in a position somewhat shifted longitudinally in relation thereto.

In the form of embodiment illustrated in FIGS. 2 to 4 the pivot member 4' encloses by means of an aperture 7 of circular configuration formed therein, a mounting member 8 secured to the top surface of the ski 1 by means of screws 9. This mounting member 8 constitutes in fact a fixed pivot or fulcrum to said member 4'. By properly shaping the holes formed in the mounting member 8, for example by providing elongated holes 10, this pivot member 4' can be adjusted in a direction perpendicular to the ski axis as already known in this field. For retaining the pivot member 4' in the vertical direction the mounting member 8 comprises a circular shoulder 11 overlapping the edge of said aperture 7 in all positions assumed by the pivot member 4' in relation to said mounting member 8. The pivot member 4' comprises on each lateral side an up-turned lug or ear 12 to which the side arms 13 (FIG. 1) of the heel hold-down device 3 are anchored.

As clearly shown notably in FIG. 3 the pivot-forming mounting member 8 covers only one fraction of the surface of said aperture 7, so that the pivot member or turntable 4 can be shifted through a distance E in the longitudinal direction of the ski. However, the fixed pivot member 8 comprises on its rear side, i.e. on the heel side, a part-circular portion 20 extending through approximately a half-circle and adapted to co-operate with the circular edge of said aperture 7 to constitute an efficient pivot means to the turntable 4 during the rotation thereof. Nevertheless, the pivot member 8 extends in the transverse direction throughout the width of the aperture 7 and comprises on one or the other side a guiding surface 15 adapted to co-operate with registering portions of the edge of said aperture 7 to ensure:

— on the one hand, the guiding of plate 4 in the longitudinal direction during the movement of the turntable in this direction, — on the other hand, the holding of this turntable against movement in the transverse direction.

Further, a resilient member is interposed between the front end of fixed pivot 8 and the front portion of the edge of aperture 7 of said turntable. In the form of embodiment illustrated in FIG. 3 this resilient member permitting a backward movement of the pivot member 4' in the longitudinal direction as shown by the arrow F (see FIG. 4) consists of a spring blade 14 bent to a loop configuration with a concave intermediate portion engaging a matching concavity formed in said fixed pivot member 8, the curved lateral arms of this loop engaging with their front faces the circular surface of the aperture 7 formed in pivot member 4'. The spring blade 14 is substantially heart-shaped and its free side arms can move relatively freely, within proper limits determined by construction, whereas the central portion of the spring blade is anchored to the pivot-forming mounting member 8. The permissible movement of the side arms of the spring blade 14 may be limited, for example, by the fact that the mounting member 8 comprises an abutment-forming surface 16 engageable by said side arms (FIG. 4). Under these circumstances if the pivoting member 4' is moved bodily backwards with the heel hold-down device 3 as when clearing a bump with the ski, it will assume at the end of this movement the position illustrated in FIG. 4. When the ground irregularities are cleared, the spring blade 14 moves the pivoting member 4' back to its initial position shown in FIG. 3.

Figure 5:
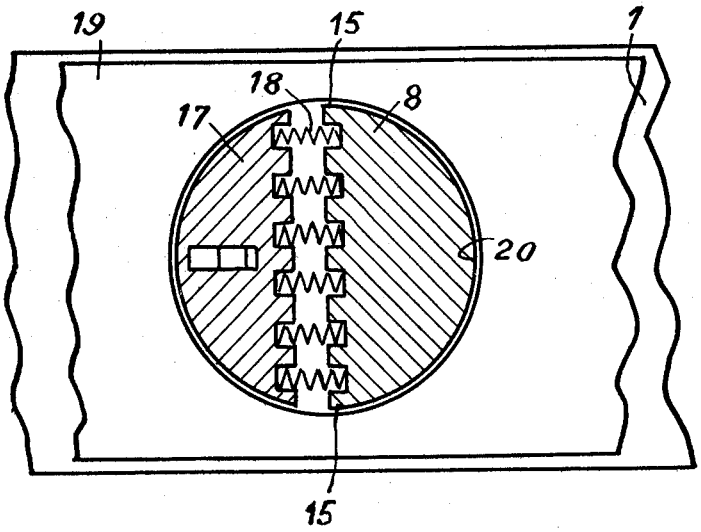
FIG. 5 is a plan view from above of a modified form of embodiment of the device of this invention, with parts shown in section.

FIG. 5 illustrates a typical form of embodiment which differs from the one disclosed hereinabove in that the resilient means comprise a movable member 17 guided in the longitudinal direction of the ski and bearing against the mounting member 8 through the medium of a plurality of coil compression springs 18. In this example, the mounting member 8 of the device according to the present invention permits the rotation of a plate 19 in the case of a plate-type binding, this plate 19 being held in position in a manner known per se by suitable safety means and therefore not to be described herein. This modified form of embodiment operates exactly like the preceding one illustrated in FIGS. 3 and 4. In both forms of embodiment there is provided on the side opposite the resilient member of mounting member 8 a co-acting surface 20 engageable by the circumferential surface of the aperture formed in the turntable or plate 19, or in the pivoting member 4'.

Stress should be laid, however, on the fact that the arrangements illustrated, notably in FIGS. 3 and 5, are to be regarded as purely diagrammatic, for a simple slot separates the bearing surface 20 from the inner circumferential surface of aperture 7. In fact, the elastic prestress of springs 14 or 18 ensures a perfect engagement with the circular surface 20 whereby the pivot axis of heel hold-down device 4 or plate 19 will have a fixed position. By using a perfectly circular aperture 7, the bearing surface 20 extends between the guiding surfaces 15, 15, rather than on the entire inner surface of one-half of said aperture 7, so that any jamming liable to interfere with the movement of the heel hold-down device 4 or turntable 19 in the longitudinal direction is positively prevented. By using a slightly elliptic aperture 7, the movement of the heel hold-down pivot device 4 or turntable 19 is permitted due to the portions of relatively small radius of curvature of the inner surface of the aperture with respect to the guiding surfaces 15. Similarly, the arrangements illustrated in FIGS. 6 and 7 are shown only diagrammatically, the distances or gaps visible in the drawings being obviously inconsistent with the actual tolerances to be provided between the fastening surfaces and the guiding surfaces.

Figure 6:
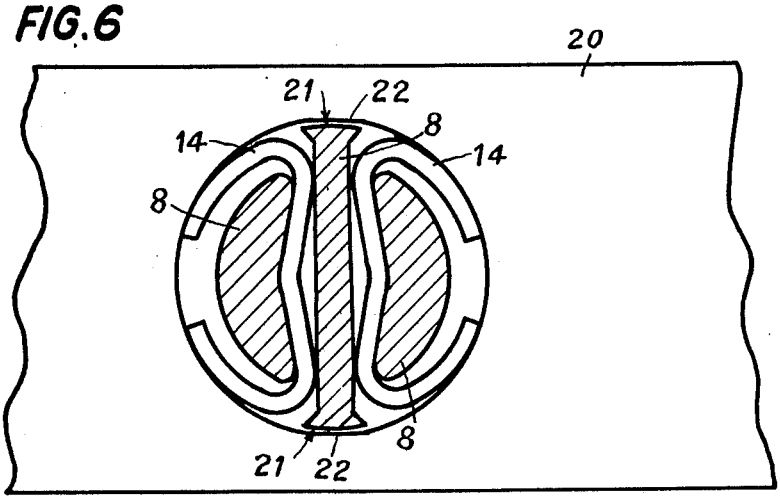
FIG. 6 is a plan view from above of a modified form of embodiment of the device of this invention, which is particularly advantageous in the case of a platform or turntable-type ski binding.
Figure 7:
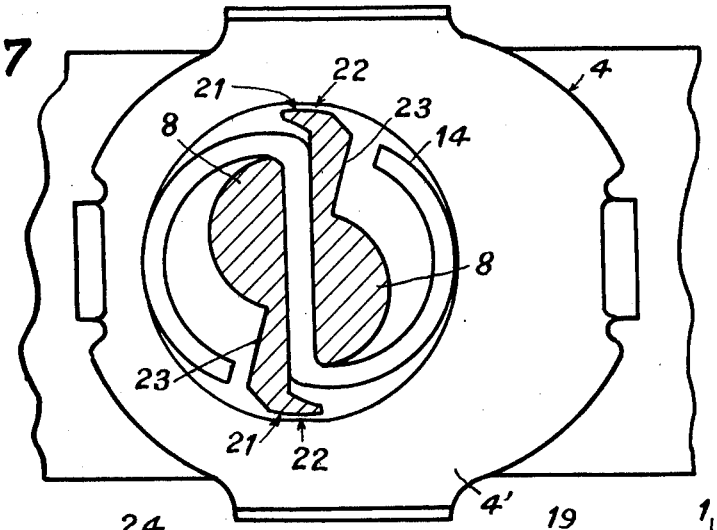
FIG. 7 illustrates a modified form of embodiment of the device in a view similar to FIG. 3.

In FIGS. 6 and 7, two other forms of embodiment of the present invention are illustrated. The construction of FIG. 6 constitutes, so to say, a geometrical doubling of the form of embodiment shown in FIGS. 1–4. The aperture in plate or turntable 19 comprises, however, and preferably in the area opposite the guiding surfaces 21 of guide member 8, slightly elliptic and/or straight guide portions 22 in the circumferential surface of this aperture. In this arrangement of the spring blades 14, the turntable 19 can move longitudinally in both ways against the resilient force of spring blades 14.

In the form of embodiment shown in FIG. 7 the aperture formed in the pivot member 4' has likewise a slightly elliptic or straight shape, the elliptic and/or straight portions 22 registering in this case with the guiding surfaces 21 of mounting member 8. The spring blade consists, in this example, of a single S-shaped member having its central portion anchored in the mounting member 8 while the free ends of the spring bear in the longitudinal direction of the ski against the circumferential surface of the aperture formed in said pivot member 4'.

Figure 8:
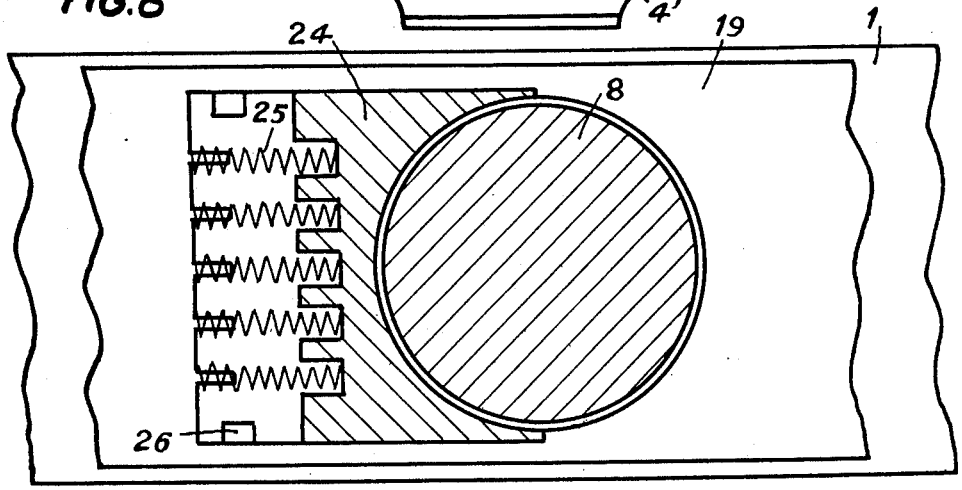
FIG. 8 is another modified form of embodiment of the device of this invention, notably for platform or turntable-type ski bindings, shown in fragmentary section similar to FIG. 5.

FIG. 8 illustrates another form of embodiment of the device of this invention which is particularly advantageous for plate, platform or turntable-type safety ski bindings. In this construction, the aperture formed in the plate or turntable 19 has a circular configuration and encloses with its inner circumference the mounting member 8 rigidly secured (like all the other mounting members of the preceding forms of embodiment) to the ski 1. In this arrangement, one-half of the circumferential surface of the circular aperture consists of a segment 24 guided in the longitudinal direction of the ski by the plate 19 and bearing in this direction against this plate 19 under the pressure of one or a plurality of coil compression springs 25. The longitudinal resilient stroke of this plate 19 in relation to the mounting member 8 and also to the ski 1 is determined by the abutments 26 formed on said plate 19 and projecting in the path of segment 24. If desired, these abutments 26 may be of the adjustable type.

Of course, this invention should not be construed as being strictly limited to the specific forms of embodiment described and illustrated herein, since various modifications and changes may be brought thereto without departing from the basic principles of the invention as set forth in the appended claims.

Having thus described the invention, what is claimed as new is:

1. A safety ski binding comprising a toe device, a supporting assembly for said boot, a heel hold down device on said supporting assembly for releasably retaining said boot, said supporting assembly comprising a supporting member for said boot, a fixed mounting member on said ski, said supporting member being rotatably and slidably mounted on said mounting member and resilient means interposed between said supporting and mounting members to control the sliding movement of said supporting member on said ski, said heel hold down device controlling rotational movement of said supporting member, said mounting member restraining said supporting member against movement of the supporting member in a direction normal to the plane of the ski.

2. The safety ski binding according to claim 1 wherein the supporting member has an aperture enclosing said mounting member within its inner circumferential surface; said mounting member being provided with guiding surfaces engageable by said inner circumferential surface of said aperture for guiding said inner surface along the ski; said mounting member engaging on at least one side the resilient means which means engage said inner circumferential surface of said aperture to apply resistive force against movement along the ski.

3. The Safety ski as recited in claim 2 wherein said resilient means comprise a curved spring blade having relatively free arms bearing against said inner circumferential surface of said aperture.

4. The Safety ski as recited in claim 2 wherein said resilient means comprise a movable member guided along the ski and bearing against said mounting member through the medium of one or a plurality of coil compression springs interposed between the movable member and mounting member.

5. The Safety skis as recited in claim 4 wherein said mounting member comprises an abutment surface on its side opposite said resilient means for engagement by said inner circumferential surface of said aperture.

6. The Safety ski binding as recited in claim 5 wherein said aperture is circular.

7. The Safety ski binding as recited in claim 6 wherein said aperture is substantially elliptic with its major diameter disposed in the longitudinal direction of the ski.

8. The Safety ski binding as recited in claim 1 wherein said supporting member, comprises a circular aperture enclosing within its inner circumferential surface the fixed mounting member, at least one portion of said inner circumferential surface being completed by a segment member slidable and guided along the ski by the supporting member to bear thereagainst through the medium of one or a plurality of springs.

* * * * *